US010026391B2

(12) United States Patent
Lin et al.

(10) Patent No.: US 10,026,391 B2
(45) Date of Patent: Jul. 17, 2018

(54) MICROPHONE DEVICE WITH TWO SOUNDS RECEIVING MODULES AND SOUND COLLECTING TROUGH

(71) Applicant: Merry Electronics(Shenzhen) Co., Ltd., Guangdong (CN)

(72) Inventors: Chia-Chung Lin, Taichung (TW); Chao-Kuan Chiang, Taichung (TW); Chien-An Lai, Taichung (TW)

(73) Assignee: Merry Electronics(Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/675,792

(22) Filed: Aug. 14, 2017

(65) Prior Publication Data

US 2018/0114520 A1 Apr. 26, 2018

Related U.S. Application Data

(63) Continuation-in-part of application No. 15/475,156, filed on Mar. 31, 2017, now Pat. No. 9,953,628.

(30) Foreign Application Priority Data

Oct. 24, 2016 (TW) ..... 105134222 A
Jun. 12, 2017 (TW) ..... 106119395 A

(51) Int. Cl.
*H04R 11/04* (2006.01)
*G10K 11/178* (2006.01)
(Continued)

(52) U.S. Cl.
CPC ..... *G10K 11/178* (2013.01); *G10K 11/1788* (2013.01); *H04R 1/083* (2013.01);
(Continued)

(58) Field of Classification Search
CPC ..... G10K 11/1788; H04R 1/08; H04R 1/083; H04R 1/406
(Continued)

(56) References Cited

U.S. PATENT DOCUMENTS 7,433,463 B2 10/2008 Alves et al.
9,330,652 B2 5/2016 Jensen et al.
2002/0110256 A1* 8/2002 Watson ..... B60R 1/12 381/389

FOREIGN PATENT DOCUMENTS

CN 101466055 6/2009
TW 079572 8/1986
(Continued)

*Primary Examiner* — Katherine Faley
(74) *Attorney, Agent, or Firm* — JCIPRNET

(57) ABSTRACT

A microphone device including a first sound receiving module, a second sound receiving module and a sound collecting trough is provided. The first sound receiving module receives a sound signal to output a first electronic signal. The second sound receiving module receives the sound signal to output a second electronic signal. The first sound receiving module is coupled to the second sound receiving module, and the phase of the first electronic signal and the phase of the second electronic signal are inverse to each other. A distance between the first sound receiving module and the sound collecting trough is smaller than a distance between the second sound receiving module and the sound collecting trough, and another sound signal is transferred to the first sound receiving module through the sound collecting trough.

15 Claims, 10 Drawing Sheets

(51) Int. Cl.
*H04R 1/40* (2006.01)
*H04R 1/08* (2006.01)
*H04R 3/00* (2006.01)

(52) U.S. Cl.
CPC ..... *H04R 1/406* (2013.01); *H04R 3/005* (2013.01); *G10K 2210/3044* (2013.01)

(58) Field of Classification Search
USPC ..... 381/71.7, 355–368
See application file for complete search history.

(56) References Cited

FOREIGN PATENT DOCUMENTS

| | | |
|---|---|---|
| TW | 201101856 | 1/2011 |
| TW | M508867 | 9/2015 |
| TW | M519307 | 3/2016 |
| TW | 201633804 | 9/2016 |

* cited by examiner

MICROPHONE DEVICE WITH TWO SOUNDS RECEIVING MODULES AND SOUND COLLECTING TROUGH

CROSS-REFERENCE TO RELATED APPLICATION

This application is a continuation-in-part application of U.S. application Ser. No. 15/475,156, filed on Mar. 31, 2017, now pending, which claims the priority benefit of Taiwan application serial no. 105134222, filed on Oct. 24, 2016. This application also claims the priority benefit of Taiwan application serial no. 106119395, filed on Jun. 12, 2017. The entirety of each of the above-mentioned patent applications is hereby incorporated by reference herein and made a part of this specification.

BACKGROUND OF THE INVENTION

Field of the Invention

The invention relates to a microphone device, more particularly relates to a microphone device capable of canceling far field noise.

Description of Related Art

Along with the continuous improvement of technology, all of electronic products have been developed with a tendency to become lighter and more miniaturized, and the electronic products like smartphone, tablet computer, or notebook, etc., have become indispensable in daily life of human beings. For each of those aforementioned electronic products, in order to allow a user/listener to listen to the audio information provided by the electronic product without disturbing the other people around, an earphone has become a necessary accessory to the electronic product. Otherwise, in order to make a phone call by using the electronic products, a headset having a microphone is also a popular accessory.

In order to perform both audio listening and sound collecting functions, a conventional headset adopts a design having an earphone and a microphone separated from each other, the earphone and the microphone are connected to each other via a signal wire or a simple structure. Therefore, the earphone is close to the ear, and the microphone is close to the mouth. However, the microphone in the above-mentioned design also receives the environmental noise, so the distinctness of the voice of the user is greatly affected. Generally speaking, the microphone has been improved both in sound-receiving efficiency and stability, and can provide clear and fluent voice quality either in a noisy environment or in high-speed movement. However, since a diaphragm for reception is a plane, phase noises are caused. That is to say, sound generated by a sounder and surrounding environmental noises may be heard by a receiver together, which interferes in the understanding of an audio message by the receiver.

SUMMARY OF THE INVENTION

Accordingly, the invention provides a microphone device capable of canceling far field environmental noise and sustaining a performance of near-field audio reception when receiving sound, so as to improve sound-receiving quality.

A microphone device according to an embodiment of the invention includes a first sound receiving module, a second sound receiving module and a sound collecting trough. The first sound receiving module receives a sound signal to output a first electronic signal. The second sound receiving module receives the sound signal to output a second electronic signal. The first sound receiving module is coupled to the second sound receiving module, and the phase of the first electronic signal and the phase of the second electronic signal are inverse to each other. A distance between the first sound receiving module and the sound collecting trough is smaller than a distance between the second sound receiving module and the sound collecting trough, and another sound signal is transferred to the first sound receiving module through the sound collecting trough.

According to an embodiment of the invention, the first sound receiving module is located between the sound collecting trough and the second sound receiving module.

According to an embodiment of the invention, the sound collecting trough has a first opening and a second opening, and the another sound signal enters the sound collecting trough via the second opening, and is transmitted toward the first sound receiving module through the first opening.

According to an embodiment of the invention, the first opening faces toward the first sound receiving module.

According to an embodiment of the invention, the microphone device further includes a sound guiding channel. The sound guiding channel is connected to the first opening and extends toward the first sound receiving module.

According to an embodiment of the invention, the microphone device further includes an acoustic resistor disposed to the first opening or the sound guiding channel.

According to an embodiment of the invention, an area of the second opening is greater than an area of the first opening.

According to an embodiment of the invention, the sound collecting trough has a bottom end opposite to the second opening, and an inner diameter of the sound collecting trough gradually increases from the bottom end toward the second opening.

According to an embodiment of the invention, the microphone device further includes an outer housing. The first sound receiving module, the second sound receiving module, and the sound collecting trough are disposed in the outer housing, the outer housing has a slot and a plurality of apertures, the slot is aligned to the sound collecting trough, and the apertures are aligned to the first sound receiving module and the second sound receiving module.

According to an embodiment of the invention, the outer housing has a top wall, a bottom wall, and a plurality of sidewalls, the top wall and the bottom wall are opposite to each other, the respective sidewalls are connected between the top wall and the bottom wall, the slot is located at one of the top wall, the bottom wall and the sidewalls, and the apertures are respectively located at the top wall, the bottom wall, and the respective sidewalls and surround the first sound receiving module and the second sound receiving module.

According to an embodiment of the invention, the outer housing has a plurality of ribs, and the sound collecting trough is positioned to the outer housing by the ribs.

According to an embodiment of the invention, a distance between the sound collecting trough and the first sound receiving module is less than 10 millimeters.

Based on the above, in the embodiments of the invention, the microphone device includes two sound receiving modules. The output terminals of the two sound receiving modules are connected with each other in parallel to result in mutual cancellation of electronic signals caused by far field noise. In addition, the microphone device further includes the sound collecting trough. The sound collecting trough is closer to one of the two sound receiving modules. Therefore, the near-field audio is able to be transmitted to one of the sound receiving modules through the sound collecting trough to sustain the performance of near-field audio reception. As a result, the sound-receiving quality of the microphone device can be greatly improved.

In order to make the aforementioned and other features and advantages of the invention more comprehensible, embodiments accompanying figures are described in detail bellows.

DESCRIPTION OF THE EMBODIMENTS

Figure 1:
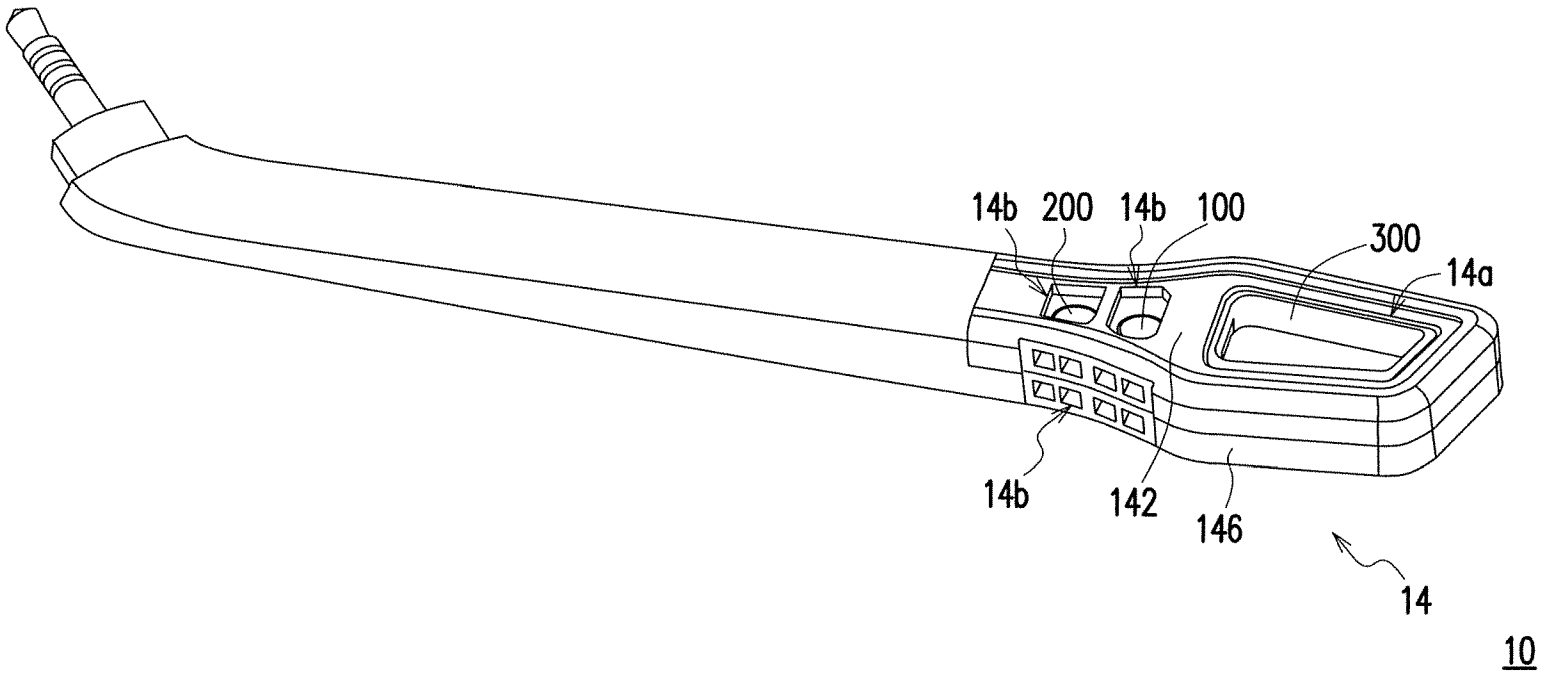
FIG. 1 is a perspective view depicting a microphone device according to an embodiment of the invention.

FIG. 1 is a perspective view illustrating a microphone device according to an embodiment of the invention. Referring to FIG. 1, a microphone device 10 of the embodiment includes a first sound receiving module 100 and a second sound receiving module 200. The first sound receiving module 100 receives a sound signal (e.g., a far-field noise) to output a first electronic signal. The second sound receiving module 200 receives the sound signal (e.g., a far-field audio) to output a second electronic signal. In addition, the first sound receiving module 100 is coupled to the second sound receiving module 200, and a phase of the first electronic signal is inverse to a phase of the second electronic signal. Accordingly, electronic signals generated based on the far-field noise are mutually cancelled out by each other.

The microphone device 10 of the embodiment further includes a sound collecting trough 300. The first sound receiving module 100 is located between the sound collecting trough 300 and the second sound receiving module 200. Accordingly, a distance between the first sound receiving module 100 and the sound collecting trough 300 is shorter than a distance between the second sound receiving module 200 and the sound collecting trough 300. Consequently, another sound signal (e.g., a near-field audio) may be transmitted to the first sound receiving module 100 via the sound collecting trough 300. Hence, a signal strength of the another sound signal (e.g., the near-field audio) transmitted to the first sound receiving module 100 is increased to prevent the another sound signal (e.g., the near-field audio) from being cancelled due to the sound cancellation effect between the first sound receiving module 100 and the second sound receiving module 200. Consequently, the performance of near-field audio reception is sustained. As a result, a sound-receiving quality of the microphone device 10 is increased. In the embodiment, the distance between the sound collecting trough 300 and the first sound receiving module 100 is less than 10 millimeters, for example. Therefore, the sound collecting trough 300 is able to effectively transmit the another sound signal (e.g., the near-field audio) to the first sound receiving module 100.

Figure 2:
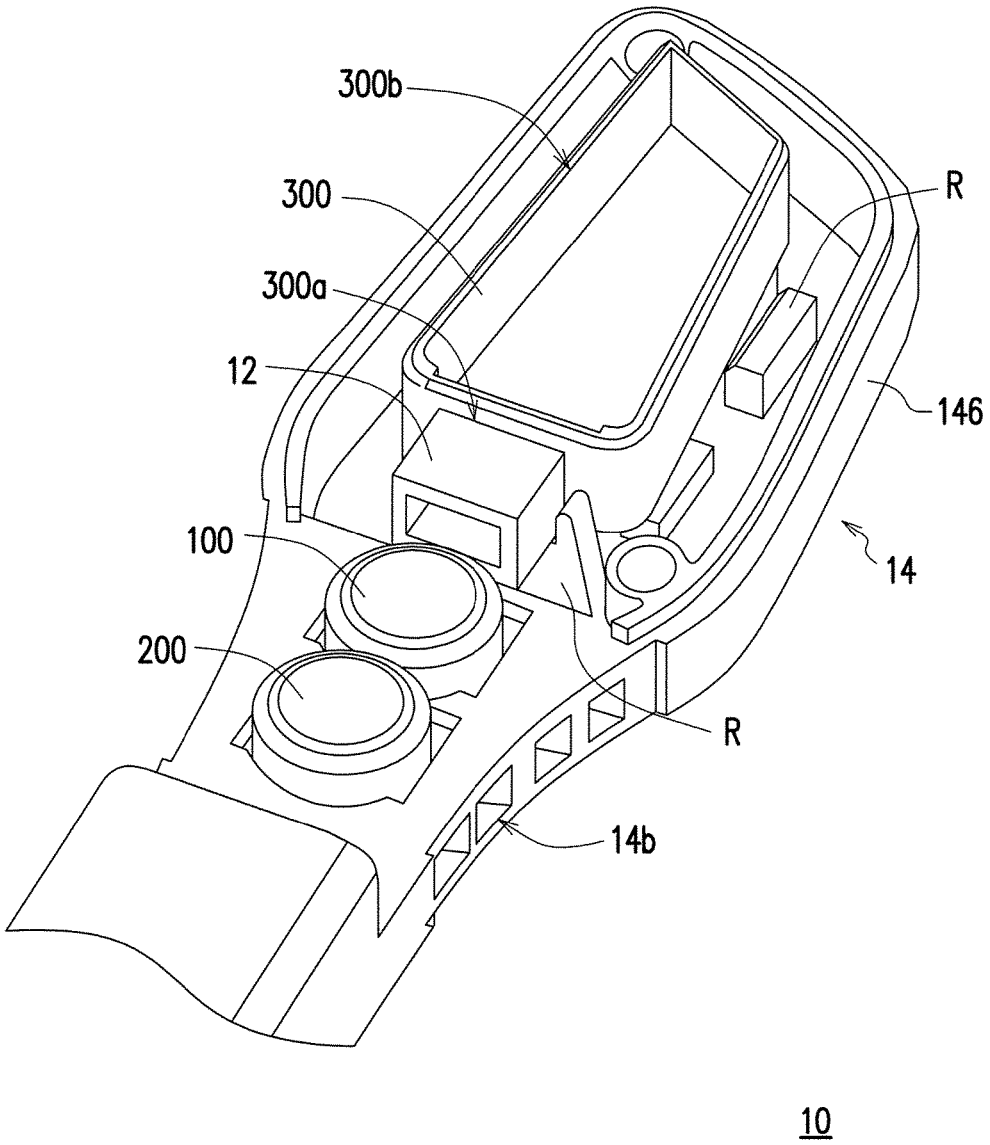
FIG. 2 is a partially enlarged view depicting the microphone device of FIG. 1.

FIG. 2 is a partially enlarged view illustrating the microphone device of FIG. 1. Referring to FIG. 2, the sound collecting trough 300 of the embodiment has a first opening 300*a* and a second opening 300*b*. The first opening 300*a* faces toward the first sound receiving module 100. The another sound signal (e.g., the near-field audio) may enter the sound collecting trough 300 through the second opening 300*b*, and is transmitted toward the first sound receiving module 100 via the first opening 300*a*. In addition, an area of the second opening 300*b* is greater than an area of the first opening 300*a*, for example, to ensure a preferable sound collecting performance of the sound collecting trough 300. Besides, the microphone device 10 of the embodiment includes a sound guiding channel 12. The sound guiding channel 12 is connected to the first opening 300*a* and extends toward the first sound receiving module 100. Accordingly, the another sound signal (e.g., the near-field audio) may be more completely transmitted to the first sound receiving module 100 through guidance of the sound guiding channel 12. In other embodiments, based on needs, an acoustic resistor, such as a metal mesh or a foam, may be further disposed to the first opening 300*a* or the sound guiding channel 12 to adjust a sound curve in a specific frequency band.

In the embodiment, as shown in FIGS. 1 and 2, the microphone device 10 includes an outer housing 14, and the first sound receiving module 100, the second sound receiving module 200, and the sound collecting trough 300 are disposed in the outer housing 14. The outer housing 14 has a slot 14*a* and a plurality of holes 14*b*. The slot 14*a* is aligned to the sound collecting trough 300 to allow the another sound signal (e.g., the near-field audio) to arrive at the sound collecting trough 300 via the slot 14*a*. The holes 14*b* are aligned to the first sound receiving module 100 and the second sound receiving module 200 to allow the sound signal (e.g., the far-field audio) to arrive at the first sound receiving module 100 and the second sound receiving module 200 via the holes 14*b*.

As shown in FIG. 2, the outer housing 14 has a plurality of ribs R. The sound collecting trough 300 is positioned to the outer housing 14 by the ribs R. In other embodiments, other suitable structures may be adopted to position the sound collecting trough 300. Alternatively, the sound collecting trough 300 may also be integrally formed and connected to the outer housing 14. The invention does not intend to impose a limitation in this regard.

Figure 3:
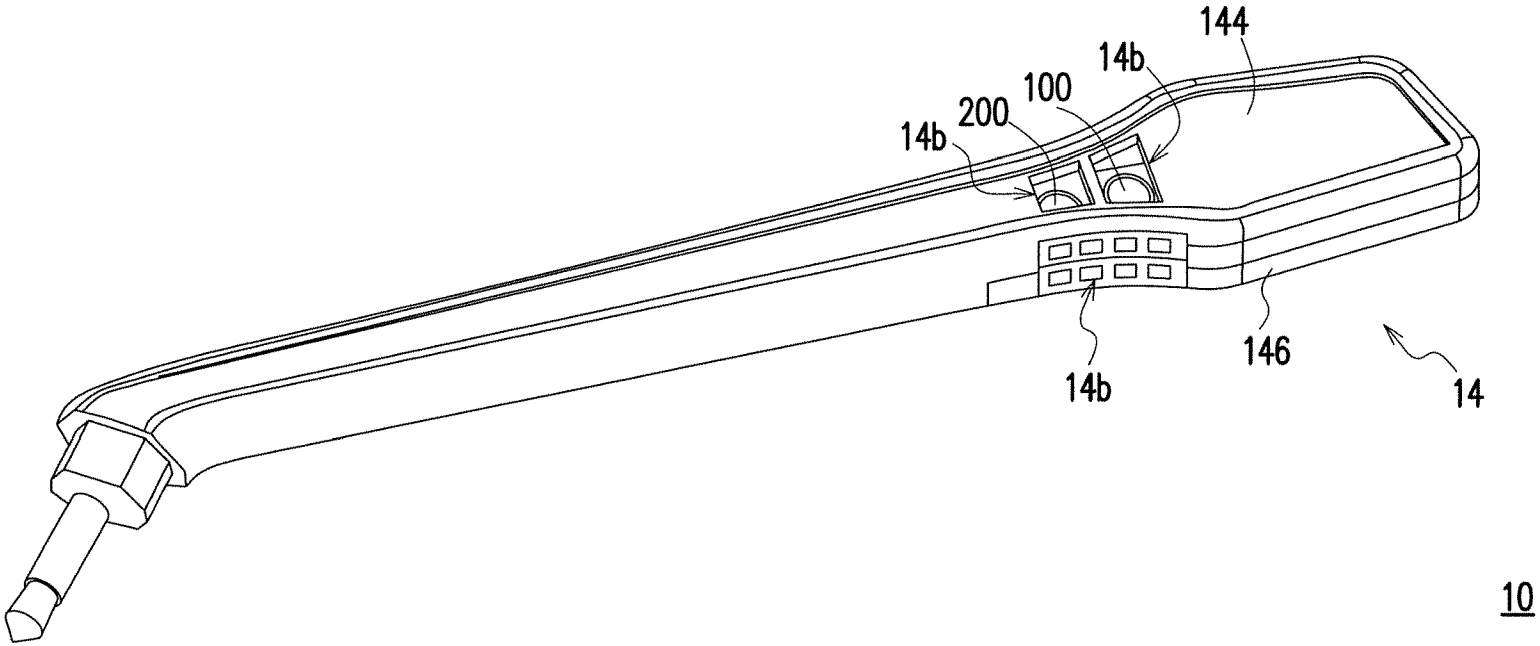
FIG. 3 is a perspective view depicting the microphone device of FIG. 1 from another perspective.

FIG. 3 is a perspective view illustrating the microphone device of FIG. 1 from another perspective. Referring to FIGS. 1 and 2, to be more specific, the outer housing 14 of the embodiment has a top wall 142, a bottom wall 144, and a plurality of sidewalls 146. The top wall 142 and the bottom wall 144 are opposite to each other, and the respective sidewalls 146 are connected between the top wall 142 and the bottom wall 144. The slot 14*a* is only located at the top wall 142 to receive the another sound signal (e.g., the near-field audio) transmitted to the sound collecting trough 300 along a predetermined direction. The apertures 14*b* are respectively located at the top wall 142, the bottom wall 144, and the respective sidewalls 146, and surround the first sound receiving module 100 and the second sound receiving module 200 to receive the sound signal (e.g., the far-field audio) transmitted to the first sound receiving module 100 and the second sound receiving module 200 in all directions.

Figure 4:
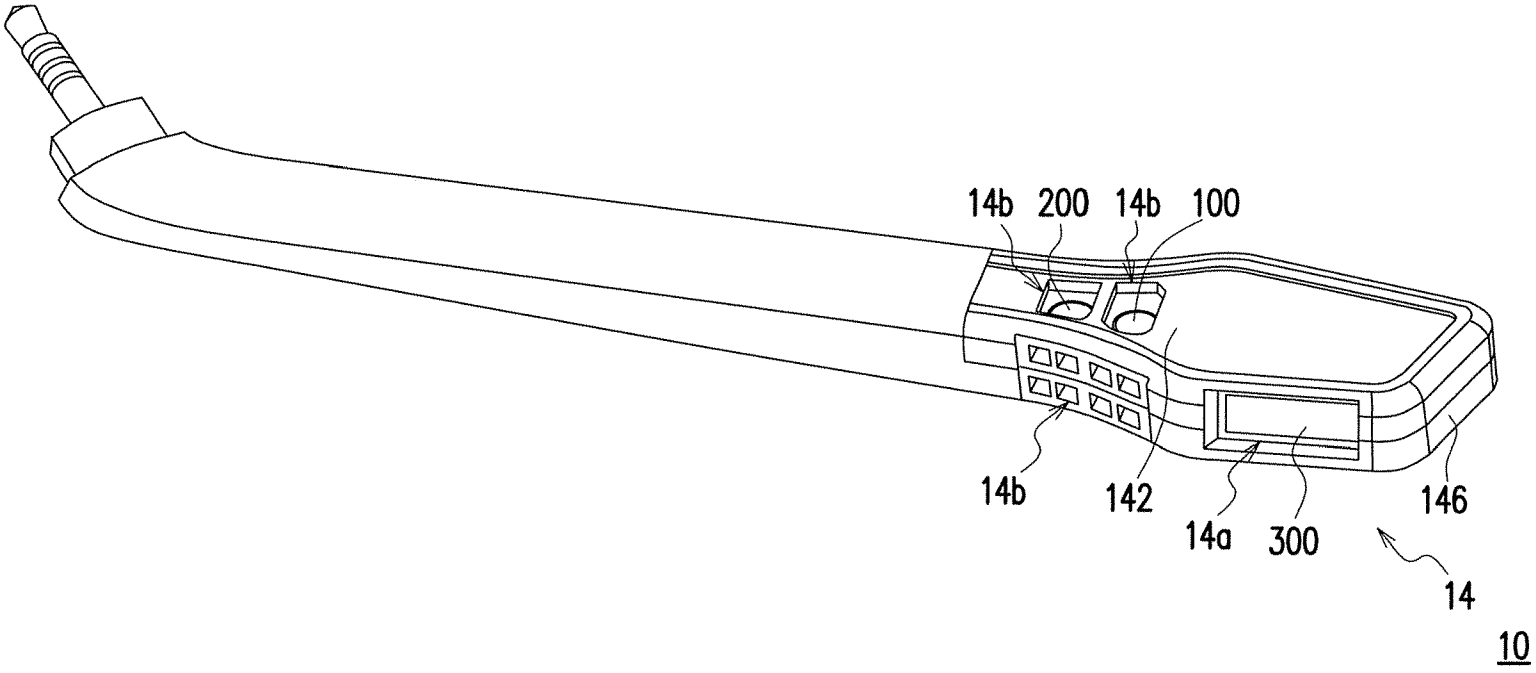
FIG. 4 is a perspective view depicting a microphone device according to another embodiment of the invention.

In other embodiments, the slot 14*a* of the outer housing 14 may be located at the bottom wall 144 or one of the sidewalls 146. The invention does not intend to impose a limitation on this regard. Relevant details are described in the following with reference to the drawings. FIG. 4 is a perspective view illustrating a microphone device according to another embodiment of the invention. As shown in FIG. 4, the slot 14*a* of the outer housing 14 is not located at the top wall 142 as shown in FIG. 1, but is located at one of the sidewalls 146.

Figure 5:
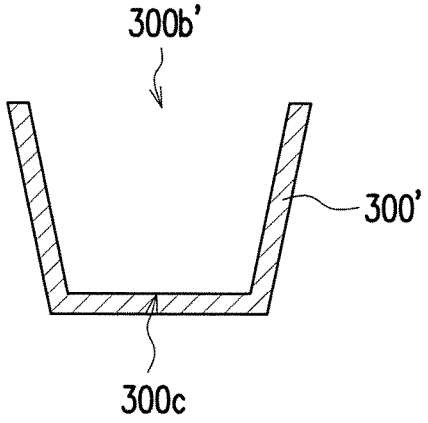
FIG. 5 is a cross-sectional view of a sound collecting trough according to another embodiment of the invention.

For a better sound collecting performance of the sound collecting trough, the structure of the sound collecting trough may be specifically designed. Details in this regard will be described in the following. FIG. 5 is a cross-sectional view of a sound collecting trough according to another embodiment of the invention. In the embodiment shown in FIG. 5, a second opening 300*b*' of the sound collecting trough 300 is opposite to a bottom end 300*c* of the sound collecting trough 300. In addition, an inner diameter of the sound collecting trough 300 gradually increases from the bottom end 300*c* of the sound collecting trough 300 toward the second opening 300*b*' to facilitate sound collecting performance of the sound collecting trough 300.

In the following, how the microphone device of the embodiment removes the far-field noise with two sound receiving modules is described in detail.

Figure 6:
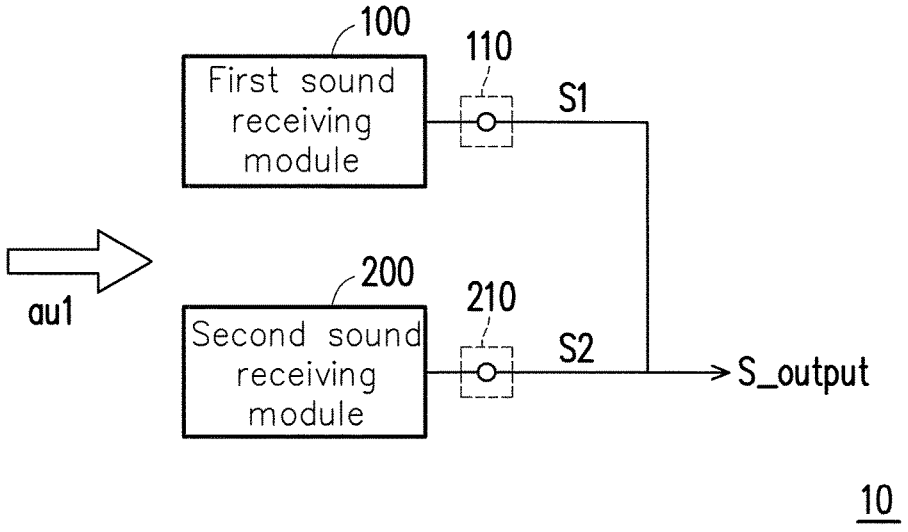
FIG. 6 is a schematic block diagram depicting a microphone device of FIG. 1.

FIG. 6 is a schematic block diagram depicting a microphone device of FIG. 1. Referring to FIG. 6, the microphone device 10 is configured to capture a sound signal au1 from outside and convert the sound signal au1 to an electronic audio signal. The first sound receiving module 100 receives the sound signal au1, and the second sound receiving module 200 is disposed adjacent to the first sound receiving module 100 to simultaneously receive the sound signal au1. Take the condenser microphone as an example, the first sound receiving module 100 includes a first diaphragm, and the second sound receiving module 200 includes a second diaphragm. The sound signal au1 can drive the first diaphragm and the second diaphragm to vibrate simultaneously. The first sound receiving module 100 has a first output terminal 110 and receives the sound signal au1 to output a first electronic signal S1 through the first output terminal 110. The second sound receiving module 200 has a second output terminal 210 and outputs a second electronic signal S2 through the second output terminal 210 accordingly. It should be noted here, the first electronic signal S1 and the second electronic signal S2 are electronic audio signals caused by far field noise components contained in the sound signal au1, and the far field noise components are the background noises of the sound signal au1, for example.

Figure 7:
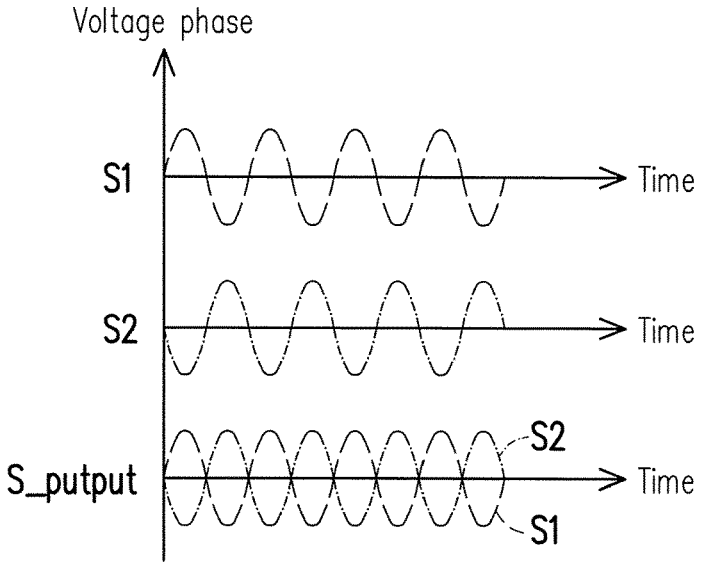
FIG. 7 is a schematic diagram depicting exemplary voltage phases of electronic signals according to one embodiment of the invention.

In the present embodiment, the first output terminal 110 of the first sound receiving module 100 is coupled to the second output terminal 210 of the second sound receiving module 200, and the phase of the first electronic signal S1 and the phase of the second electronic signal S2 are inverse to each other. Based on this, the first output terminal 110 and the second output terminal 210 are connected in a parallel manner to result in mutual cancellation of the first electronic signal S1 and the second electronic signal S2. To be more specific, FIG. 7 is a schematic diagram depicting exemplary voltage phases of electronic signals according to one embodiment of the invention. Referring to FIG. 7, the voltage phase of the first electronic signal S1 and the voltage phase of the second electronic signal S2 are inverse to each other. Since the first output terminal 110 and the second output terminal 210 are connected to each other in parallel, the first electronic signal S1 and the second electronic signal S2 cancel each other out to keep an output signal S_output at a specific voltage phase (such as 0 volt). Therefore, the microphone device of the invention can filter the far field noise out in sound-receiving process in order to improve sound-receiving quality of the microphone device.

Figure 8:
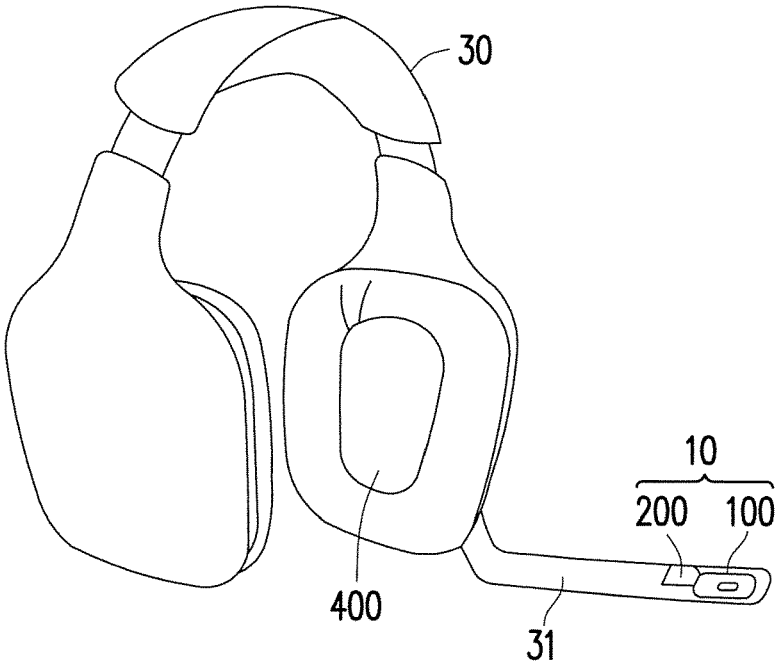
FIG. 8 is a schematic view depicting application of a microphone device according to one embodiment of the invention.

FIG. 8 is a schematic view depicting application of a microphone device according to one embodiment of the invention. Referring to FIG. 6 to FIG. 8, an earphone microphone 30 may include the microphone device 10 and an earphone 400. Earmuffs of the earphone 400 are designed to cover the ears of the user, the microphone device 10 is disposed at an end of an extending structure 31 so that the microphone device 10 can be close to the mouth of the user. In other words, the first sound receiving module 100 and the second sound receiving module 200 of the microphone device 10 are disposed adjacent to each other on the extending structure 31. The microphone device 10 is structurally or electrically designed so that the phases of the first electronic signal S1 and the second electronic signal S2 are inverse to each other. Hence, through connecting the output terminal of the first sound receiving module 100 and the output terminal of the second sound receiving module 200 in parallel, the earphone microphone 30 can filter out the background noise, which is the far field component, so as to improve the sound receiving effect to make the human voice more clear. Although FIG. 8 depicts an exemplary application that the microphone device 10 is disposed on the earphone microphone, the invention is not limited thereto. For example, the microphone device of the invention may be provided in a headset microphone or a speakerphone microphone.

Figure 9A:
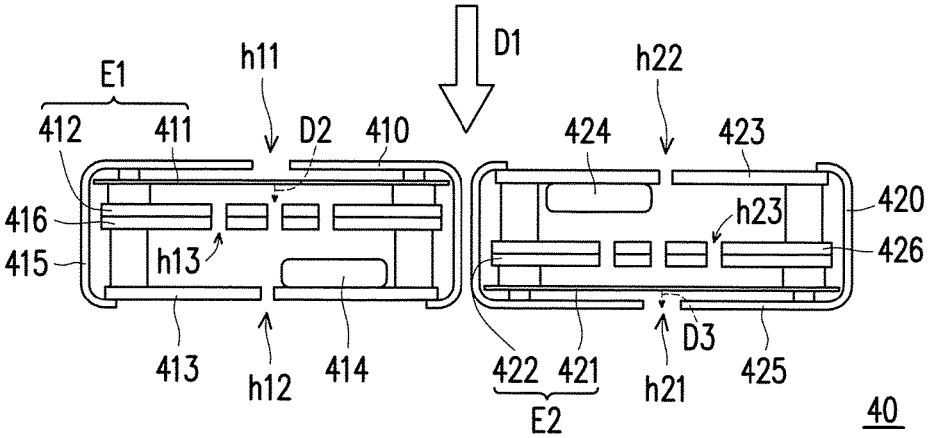
FIG. 9A is a cross-sectional schematic view depicting a microphone device according to one embodiment of the invention.
Figure 9B:
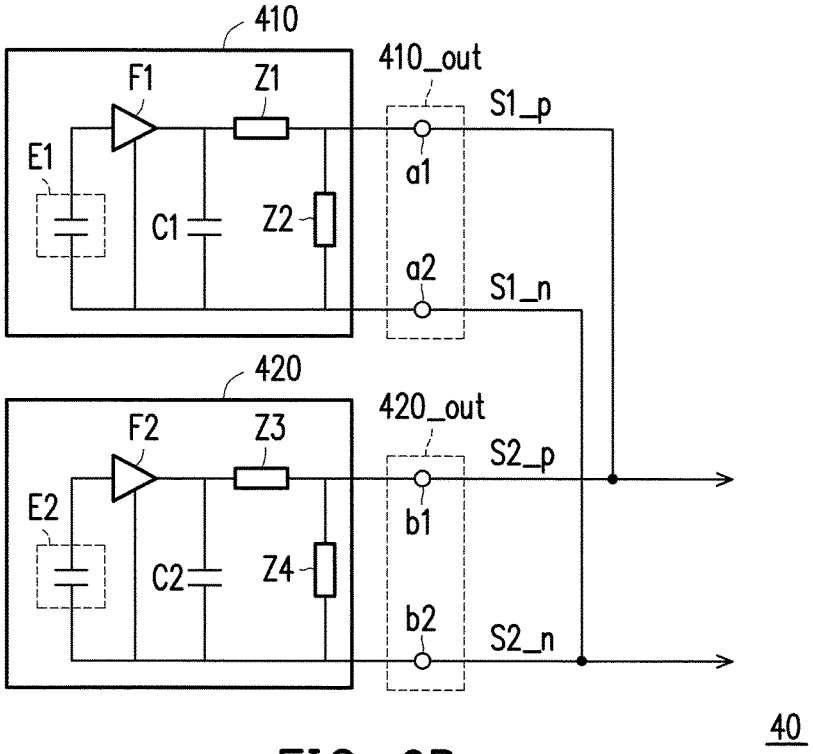
FIG. 9B is a schematic view depicting an electric circuit of a microphone device according to one embodiment of the invention.

Several exemplary embodiments are described below to illustrate the invention in detail. FIG. 9A is a cross-sectional schematic view depicting a microphone device according to one embodiment of the invention. FIG. 9B is a schematic view depicting an electric circuit of a microphone device according to one embodiment of the invention. Referring to FIG. 9A, in the present embodiment, a first sound receiving module 410 and a second sound receiving module 420 are constituted by at least two bidirectional microphones, for example. A microphone device 40 includes the first sound receiving module 410 and the second sound receiving module 420 disposed adjacent to one another, and the first sound receiving module 410 and the second sound receiving module 420 together receive a sound signal transmitted along a sound pressure direction D1. The first sound receiving module 410 includes a first diaphragm 411, a first electrode plate 412, a substrate 413, an audio processing integrated circuit 414, a first housing 415, and a supporting plate 416. The second sound receiving module 420 includes a second diaphragm 421, a second electrode plate 422, a substrate 423, an audio processing integrated circuit 424, a first housing 425, and a supporting plate 426.

To be more specific, a first space formed by the first housing 415 and the substrate 413 and a second space formed by the second housing 425 and the substrate 423 are separated from and independent of each other. The first diaphragm 411, the first electrode plate 412, the audio processing integrated circuit 414, and the supporting plate 416 are disposed inside the first space formed by the first housing 415 and the substrate 413, and the second diaphragm 421, the second electrode plate 422, the audio processing integrated circuit 424, and the supporting plate 426 are disposed inside the second space formed by the second housing 425 and the substrate 423.

In the present embodiment, the first diaphragm 411 and the first electrode plate 412 forms two electrodes of a microphone unit E1. The substrate 413 may be a printed circuit board (PCB) on which the audio processing integrated circuit 414 is disposed, and the substrate 413 has a bottom pore h12. The supporting plate 416 is configured to support the first electrode plate 412, and the supporting plate 416 and the first electrode plate 412 have a plurality of pores (such as pore h13).

The first sound receiving module 410 has a first sound-receiving hole h11, the sound signal presses along the sound pressure direction D1 and toward the first diaphragm 411 through the first sound-receiving hole h11. When the first diaphragm 411 starts receiving the sound wave from the sound signal, the first diaphragm 411 starts vibrating to result in changes in capacitance value, which leads to changes in the output voltage of the microphone unit E1.

In the present embodiment, the structure and the operating principle of the second sound receiving module 420 are the same as that of the first sound receiving module 410 and will not be repeated hereinafter. It should be noted here, compared to the first sound receiving module 410, the second sound receiving module 420 is placed in an upside down manner. In other words, an opening direction of the first sound-receiving hole h11 and an opening direction of the second sound-receiving hole h21 are opposite directions. As a result, when the first sound receiving module 410 receives sound through the first sound-receiving hole h11 at the top of the first sound receiving module 410, the second sound receiving module 420 receives sound through a pore h22 at the bottom of the second sound receiving module 420. Specifically, the sound signal presses along the sound pressure direction D1 and towards the second diaphragm 421 through the pore h22 and the pore h23. When the second diaphragm 421 starts receiving the sound wave from the sound signal, the second diaphragm 421 starts vibrating to result in changes in capacitance value, which leads to changes in the output voltage of the microphone unit E2. Overall, when the first sound receiving module 410 and the second sound receiving module 420 together receive the sound signal transmitted along the sound pressure direction D1, a motion direction D2 of the first diaphragm 411 with respect to the first electrode plate 412 and a motion direction D3 of the second diaphragm 421 with respect to the second electrode plate 422 are opposite each other.

Next, referring to FIG. 9B, the first sound receiving module 410 further includes a first amplifier F1, a capacitor C1, and impedance components Z1 to Z2. An input terminal of the first amplifier F1 is coupled with the first electrode plate 412 of the microphone unit E1 to output the first electronic signal to the first output terminal 410_out in response to vibration of the first diaphragm 411. In view of this, the first output terminal 410_out includes an output terminal a1 and a ground terminal a2, and the first electronic signal outputted from the first sound receiving module 410 includes a first output electronic signal S1_*p* and a first ground electronic signal S1_*n*.

Similarly, the second sound receiving module 420 further includes a second amplifier F2, a capacitor C2, and impedance components Z3 to Z4. An input terminal of the second amplifier F2 is coupled with the second electrode plate 422 of the microphone unit E2 to output the second electronic signal to the second output terminal 420_out in response to vibration of the second diaphragm 421. In view of this, the second output terminal 420_out includes an output terminal b1 and a ground terminal b2, and the second electronic signal outputted from the second sound receiving module 420 includes a second output electronic signal S2_*p* and a second ground electronic signal S2_*n*.

The first output terminal 410_out is coupled with the second output terminal 420_out. To be more specific, the output terminal a1 of the first output terminal 410_out is coupled to the output terminal b1 of the second output terminal 420_out, and the ground terminal a2 of the first output terminal 410_out is coupled to the ground terminal b2 of the second output terminal 420_out. Under the circumstance that the first output terminal 410_out is connected with the second output terminal 420_out in parallel, since the motion direction D2 of the first diaphragm 411 in the microphone unit E1 with respect to the first electrode plate 412 and the motion direction D3 of the second diaphragm 421 in the microphone unit E2 with respect to the second electrode plate 422 are opposite each other, the first output electronic signal S1_*p* and the second output electronic signal S2_*p* caused by far field noise components contained in the sound signal can cancel each other out. As a result, the microphone device 40 can filter the signal component caused by far field noise out, so as to improve sound-receiving quality.

Figure 10:
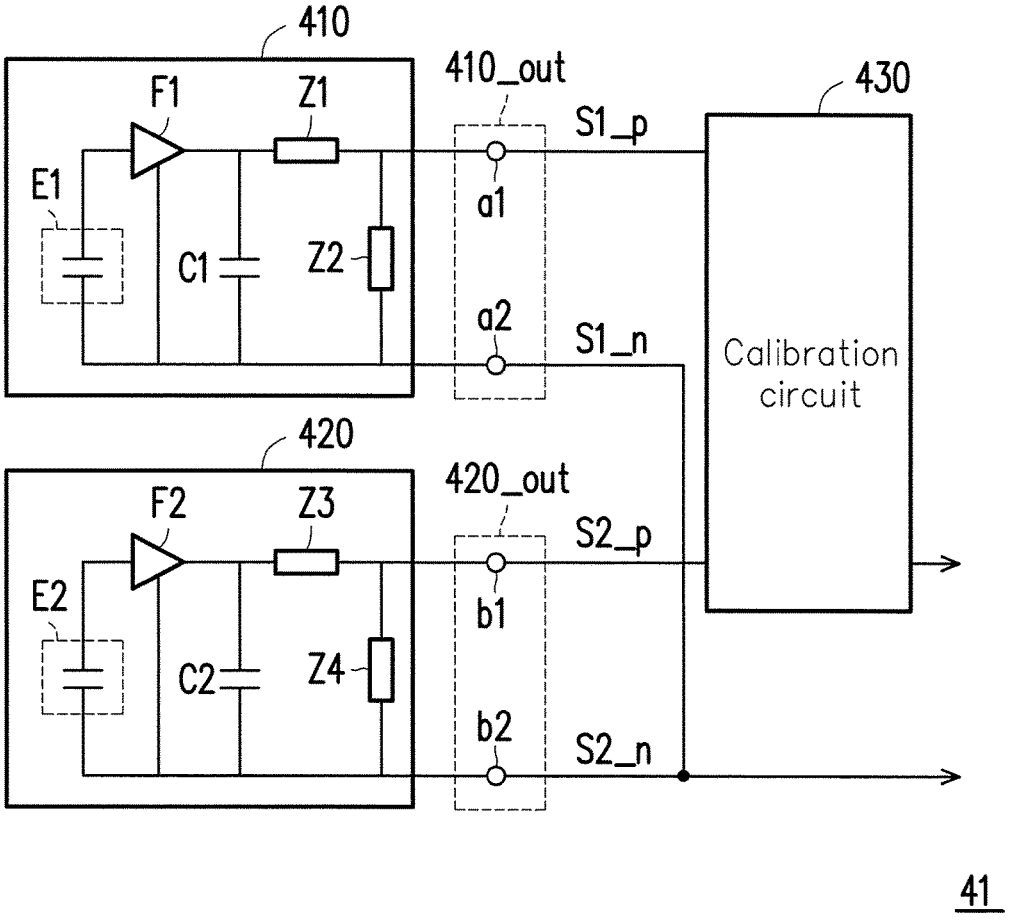
FIG. 10 is a schematic view depicting an electric circuit of a microphone device according to one embodiment of the invention.

FIG. 10 is a schematic view depicting an electric circuit of a microphone device according to one embodiment of the invention. Referring to FIG. 10, similarly, the microphone device 41 in the present embodiment includes the first sound receiving module 410 and the second sound receiving module 420. The first output terminal 410_out of the first sound receiving module 410 and the second output terminal 420_out of the second sound receiving module 420 are connected with each other in parallel. Compared to the microphone device 40 in the aforementioned embodiment, the microphone device 41 in present embodiment further includes a calibration circuit 430. The calibration circuit 430 is coupled to the first sound receiving module 410 and the second sound receiving module 420 to receive the first electronic signal outputted from the first sound receiving module 410 and the second electronic signal outputted from the second sound receiving module 420. The calibration circuit 430 performs matching calibration for the first electronic signal and the second electronic signal, so as to guarantee that the first electronic signal and the second electronic signal caused by far field noise components contained in the sound signal can completely cancel each other out. In the embodiment of FIG. 5, the calibration circuit 430 is coupled between the output terminal a1 of the first output terminal 410_out and the output terminal b1 of the second output terminal 420_out, and the calibration circuit 430 is a RC circuit composed of resistors and capacitors, for example, the invention is not limited thereto. However, the structure of the two bidirectional microphones illustrated in FIG. 4A is an example for clearly describing the concept of the invention, but the invention is not limited thereto. For example, in the other embodiment, the electrode plates of the two bidirectional microphones may be affixed on a printed circuit board.

Figure 11A:
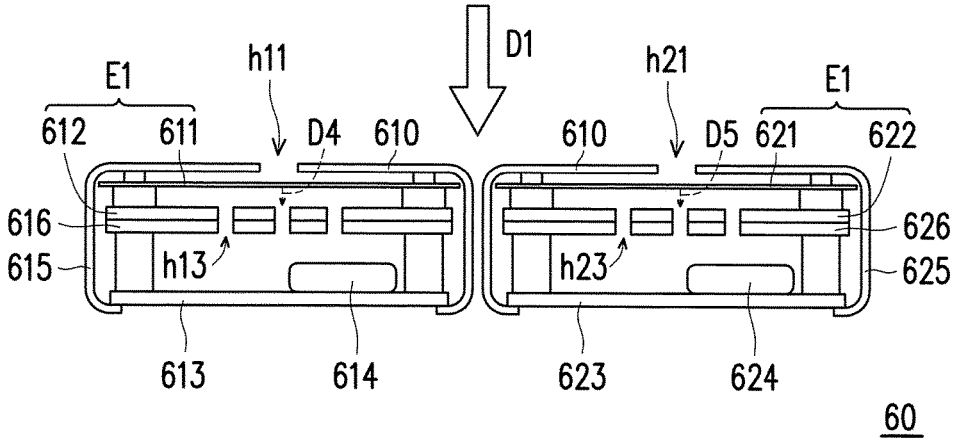
FIG. 11A is a cross-sectional schematic view depicting a microphone device according to one embodiment of the invention.
Figure 11B:
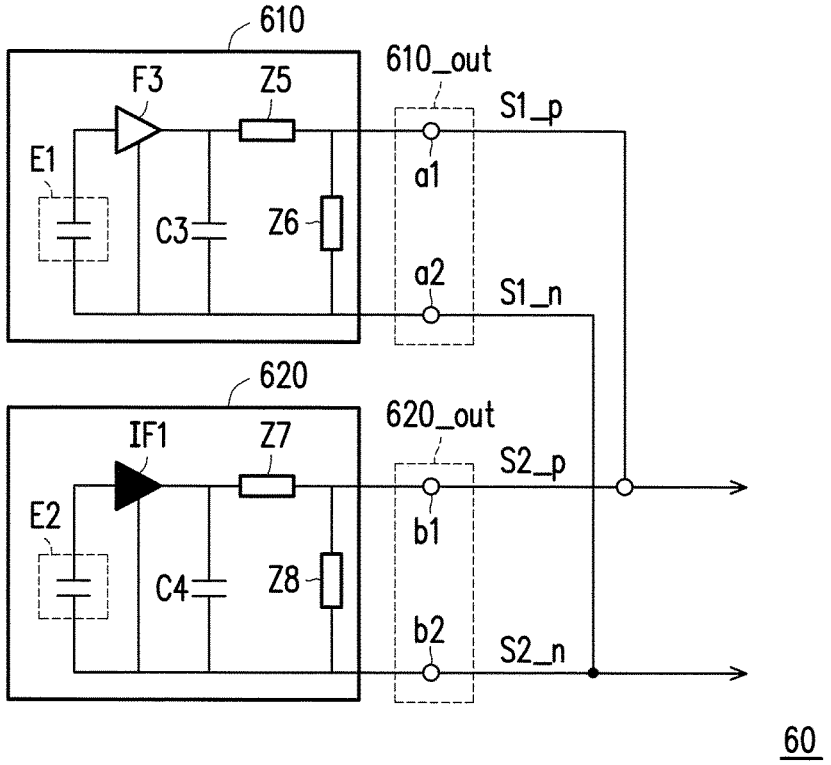
FIG. 11B is a schematic view depicting an electric circuit of a microphone device according to one embodiment of the invention.

FIG. 11A is a cross-sectional schematic view depicting a microphone device according to one embodiment of the invention. FIG. 11B is a schematic view depicting an electric circuit of a microphone device according to one embodiment of the invention. Referring to FIG. 11A, in the present embodiment, a first sound receiving module 610 and a second sound receiving module 620 are constituted by at least two omnidirectional microphones, for example. A microphone device 60 includes the first sound receiving module 610 and the second sound receiving module 620 disposed adjacent to one another, and the first sound receiving module 610 and the second sound receiving module 620 together receive a sound signal transmitted along a sound pressure direction D1. The first sound receiving module 610 includes a first diaphragm 611, a first electrode plate 612, a substrate 613, an audio processing integrated circuit 614, a first housing 615, and a supporting plate 616. The second sound receiving module 620 includes a second diaphragm 621, a second electrode plate 622, a substrate 623, an audio processing integrated circuit 624, a first housing 625, and a supporting plate 626.

To be more specific, a first space formed by the first housing 615 and the substrate 613 and a second space formed by the second housing 625 and the substrate 623 are separated from and independent of each other. The first diaphragm 611, the first electrode plate 612, the audio processing integrated circuit 614, and the supporting plate 616 are disposed inside the first space formed by the first housing 615 and the substrate 613, and the second diaphragm 621, the second electrode plate 622, the audio processing integrated circuit 624, and the supporting plate 626 are disposed inside the second space formed by the second housing 625 and the substrate 623.

In the present embodiment, the structure and the operating principle of the first sound receiving module 610 are the same as that of the first sound receiving module 410 shown in FIG. 9A and will not be repeated hereinafter. The structure and the operating principle of the second sound receiving module 620 are the same as that of the first sound receiving module 410 shown in FIG. 9A and will not be repeated hereinafter.

It should be noted here, the differences between the present embodiment and the embodiment in FIG. 9 are that the first sound receiving module 610 and the second sound receiving module 620 are placed in order to orient the sound-receiving holes toward the same direction. In other words, an opening direction of a first sound-receiving hole h11 of the first sound receiving module 610 and an opening direction of a second sound-receiving hole h21 of the second sound receiving module 620 are the same direction. As a result, when the first sound receiving module 610 receives sound through the first sound-receiving hole h11 at the top of the first sound receiving module 610, similarly, the second sound receiving module 620 also receives sound through the second sound-receiving hole h21 at the top of the second sound receiving module 620. Specifically, the sound signal presses along the sound pressure direction D1, through the first sound-receiving hole h11 and the second sound-receiving hole h21, and towards the first diaphragm 611 the second diaphragm 621. Overall, when the first sound receiving module 410 and the second sound receiving module 420 together receive the sound signal transmitted along the sound pressure direction D1, the sound signal drives the first diaphragm 611 and the second diaphragm 621 to vibrate simultaneously, and an motion direction D4 of the first diaphragm 611 with respect to the first electrode plate 612 and an motion direction D5 of the second diaphragm 621 with respect to the second electrode plate 622 are the same.

Next, referring to FIG. 11B, the first sound receiving module 610 further includes a first amplifier F3, a capacitor C3, and impedance components Z5 to Z6. An input terminal of the first amplifier F3 is coupled with the first electrode plate 612 of the microphone unit E1 to output the first electronic signal to the first output terminal 610_out in response to vibration of the first diaphragm 611. In view of this, the first output terminal 610_out includes an output terminal a1 and a ground terminal a2, and the first electronic signal outputted from the first sound receiving module 610 includes a first output electronic signal S1_*p* and a first ground electronic signal S1_*n*. Similarly, the second sound receiving module 620 further includes a second amplifier IF1, a capacitor C4, and impedance components Z7 to Z8. An input terminal of the second amplifier IF1 is coupled with the second electrode plate 622 of the microphone unit E2 to output the second electronic signal to the second output terminal 620_out in response to vibration of the second diaphragm 621. In view of this, the second output terminal 620_out includes an output terminal b1 and a ground terminal b2, and the second electronic signal outputted from the second sound receiving module 620 includes a second output electronic signal S2_*p* and a second ground electronic signal S2_*n* that are inverse to each other.

It should be noted here, in the present embodiment, the first amplifier F3 includes a non-inverting amplifier, and the second amplifier IF1 includes an inverting amplifier. Although the motion direction D4 of the first diaphragm 611 in the microphone unit E1 with respect to the first electrode plate 612 and the motion direction D5 of the second diaphragm 621 in the microphone unit E2 with respect to the second electrode plate 622 are the same, the second amplifier IF1 can reverse the phase of the second electronic signal generated by the microphone unit E2. Therefore, under the circumstance that the first output terminal 610_out is connected with the second output terminal 620_out in parallel, the first output electronic signal S1_*p* and the second output electronic signal S2_*p* caused by far field noise components contained in the sound signal can cancel each other out. As a result, the microphone device 60 can filter the signal component caused by far field noise out, so as to improve sound-receiving quality.

Figure 12A:
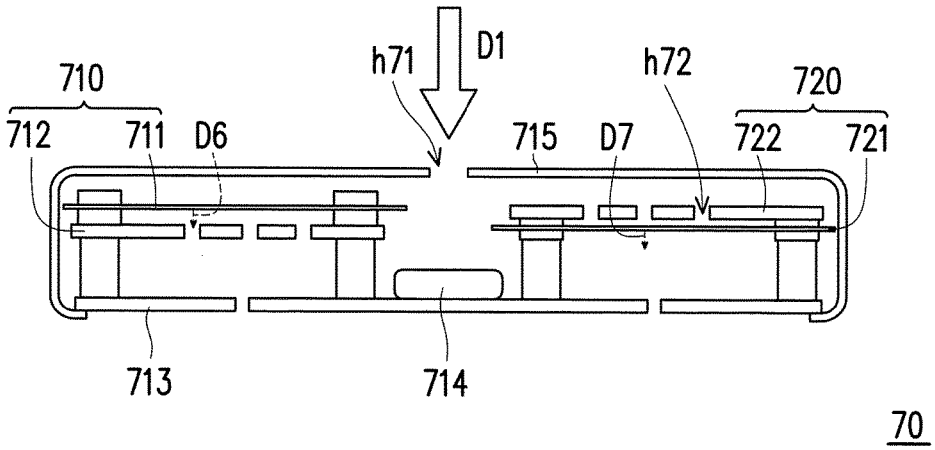
FIG. 12A is a cross-sectional schematic view depicting a microphone device according to one embodiment of the invention.
Figure 12B:
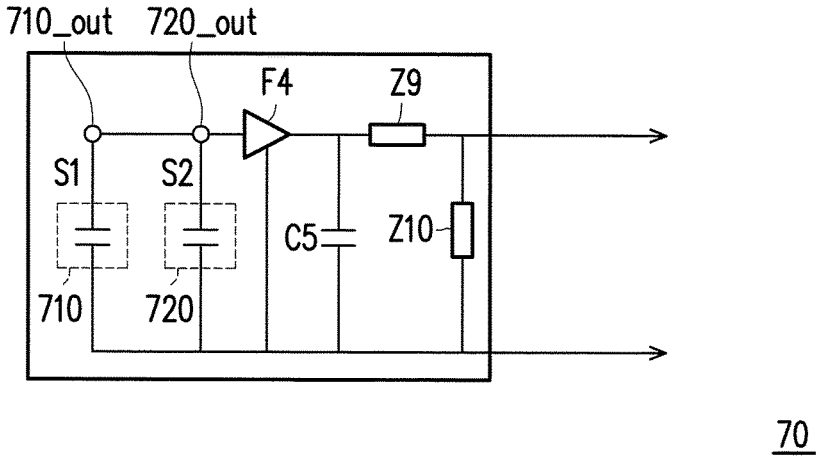
FIG. 12B is a schematic view depicting an electric circuit of a microphone device according to one embodiment of the invention.

FIG. 12A is a cross-sectional schematic view depicting a microphone device according to one embodiment of the invention. FIG. 12B is a schematic view depicting an electric circuit of a microphone device according to one embodiment of the invention. Referring to FIG. 12A, the microphone device 70 may include a first sound receiving module 710, a second sound receiving module 720, a substrate 713, an audio processing integrated circuit 714, and a housing 715. The first sound receiving module 710 includes a first diaphragm 711 and a first electrode plate 712, and the second sound receiving module 720 includes a second diaphragm 721 and a second electrode plate 722. The sound signal transmitted along the sound pressure direction D1 drives the first diaphragm 711 and the second diaphragm 721 to vibrate simultaneously. The materials of the first diaphragm 711 and the second diaphragm 721 are conductive materials, and the first electrode plate 712 and the second electrode plate 722 may be made of electret material, the invention is not limited thereto. In another embodiment, the first diaphragm 711 and the second diaphragm 721 may be made of electret material, and the materials of the first electrode plate 712 and the second electrode plate 722 may be conductive materials. The first electrode plate 712 and the second electrode plate 722 have a plurality of pores (such as pore h72).

It should be noted here, in the present embodiment, each of the first sound receiving module 710 and the second sound receiving module 720 is a microphone unit constituted by a diaphragm and an electrode plate. The first sound receiving module 710 and the second sound receiving module 720 are disposed inside a space formed by the housing 715 and the substrate 714 to receive the sound signal from outside via the same sound-receiving hole h71. Moreover, the first diaphragm 711 is disposed above the first electrode plate 712, and the second diaphragm 721 is disposed under the second electrode plate 722. In other words, when the sound signal presses through the sound-receiving hole h71 towards the first diaphragm 711 and the second diaphragm 721, the first diaphragm 711 moves in a direction D6 to be close to the first electrode plate 712, but the second diaphragm 721 moves in a direction D7 to be far away from the second electrode plate 722. Moreover, the motion direction of the first diaphragm 711 with respect to the first electrode plate 712 and the motion direction of the second diaphragm 721 with respect to the second electrode plate 722 are opposite each other.

Referring to FIG. 12B again, the first output terminal 710_out of the first sound receiving module 710 is coupled to the second output terminal 720_out of the second sound receiving module 720. In other words, the first sound receiving module 710 and the second sound receiving module 720 are connected in parallel with each other. The microphone device 70 further includes an amplifier F4, a capacitor C5, and impedance components Z9 to Z10. An input terminal of the amplifier F4 is coupled with the first output terminal 710_out and the second output terminal 720_out to receive the first electronic signal S1 and the second electronic signal S2. Under the circumstance that the first output terminal 710_out of the first sound receiving module 710 is connected in parallel with the second output terminal 720_out of the second sound receiving module 720, since the motion direction of the first diaphragm 711 with respect to the first electrode plate 712 and the motion direction of the second diaphragm 721 with respect to the second electrode plate 722 are opposite each other, the first electronic signal S1 and the second electronic signal S2 caused by far field noise components contained in the sound signal can cancel each other out (as shown in FIG. 7). As a result, the microphone device 70 can filter the signal component caused by far field noise out, so as to improve sound-receiving quality.

In view of the foregoing, in the embodiments of the invention, the microphone device includes the first sound receiving module and the second sound receiving module. The respective output ends of the first sound receiving module and the second sound receiving module are connected with each other in parallel to cancel the electronic signals generated based on the far-field noise. In addition, the microphone device further includes the sound collecting trough. The sound collecting trough is closer to the first sound receiving module and more distant to the second sound receiving module. Therefore, the near-field audio is able to be transmitted to the first sound receiving module through the sound collecting trough. Accordingly, the signal strength of the near-field audio transmitted to the first sound receiving module is increased, and the near-field audio is prevented from being cancelled due to the sound cancellation effect between the first sound receiving module and the second sound receiving module. Consequently, the performance of near-field audio reception is sustained. As a result, a sound-receiving quality of the microphone device is increased.

Although the invention has been disclosed with reference to the aforesaid embodiments, they are not intended to limit the invention. It will be apparent to one of ordinary skill in the art that modifications and variations to the described embodiments may be made without departing from the spirit and the scope of the invention. Accordingly, the scope of the invention will be defined by the attached claims and not by the above detailed descriptions.

What is claimed is:

1. A microphone device, comprising:

a first sound receiving module, receiving a sound signal to output a first electronic signal;

a second sound receiving module, receiving the sound signal to output a second electronic signal, wherein the first sound receiving module is coupled to the second sound receiving module, and a phase of the first electronic signal is inverse to a phase of the second electronic signal;

a sound collecting trough, wherein a distance between the first sound receiving module and the sound collecting trough is shorter than a distance between the second sound receiving module and the sound collecting trough, and another sound signal passes through the sound collecting trough and is transmitted to the first sound receiving module; and an outer housing, wherein the first sound receiving module, the second sound receiving module, and the sound collecting trough are disposed in the outer housing, the outer housing has a slot and a plurality of apertures, the slot is aligned to the sound collecting trough, and the apertures are directly aligned to the first sound receiving module and the second sound receiving module, so that far-field audio arrives directly and equally at the first sound receiving module and the second sound receiving module.

2. The microphone device as claimed in claim 1, wherein the first sound receiving module is located between the sound collecting trough and the second sound receiving module.

3. The microphone device as claimed in claim 1, wherein the sound collecting trough has a first opening and a second opening, and the another sound signal enters the sound collecting trough via the second opening, and is transmitted toward the first sound receiving module through the first opening.

4. The microphone device as claimed in claim 3, wherein the first opening faces toward the first sound receiving module.

5. The microphone device as claimed in claim 3, further comprising a sound guiding channel connected to the first opening and extending toward the first sound receiving module.

6. The microphone device as claimed in claim 5, further comprising an acoustic resistor disposed to the first opening or the sound guiding channel.

7. The microphone device as claimed in claim 3, wherein an area of the second opening is greater than an area of the first opening.

8. The microphone device as claimed in claim 3, wherein the sound collecting trough has a bottom end opposite to the second opening, and an inner diameter of the sound collecting trough gradually increases from the bottom end toward the second opening.

9. The microphone device as claimed in claim 1, wherein the outer housing has a top wall, a bottom wall, and a plurality of sidewalls, the top wall and the bottom wall are opposite to each other, the respective sidewalls are connected between the top wall and the bottom wall, the slot is located at one of the top wall, the bottom wall and the sidewalls, and the apertures are respectively located at the top wall, the bottom wall, and the respective sidewalls and surround the first sound receiving module and the second sound receiving module.

10. The microphone device as claimed in claim 1, wherein the outer housing has a plurality of ribs, and the sound collecting trough is positioned to the outer housing by the ribs.

11. The microphone device as claimed in claim 1, wherein a distance between the sound collecting trough and the first sound receiving module is less than 10 millimeters.

12. The microphone device as claimed in claim 1, wherein the apertures expose the first sound receiving module and the second sound receiving module.

13. The microphone device as claimed in claim 1, wherein the apertures are adjacent to both of the first sound receiving module and the second sound receiving module.

14. The microphone device as claimed in claim 1, wherein the area of the slot is larger than the area of each of the apertures.

15. The microphone device as claimed in claim 5, wherein the sound guiding channel is located between the first sound receiving module and the first opening.

* * * * *